US008040064B2

(12) United States Patent
Yamaryo et al.

(10) Patent No.: US 8,040,064 B2
(45) Date of Patent: Oct. 18, 2011

(54) PLASMA DISPLAY PANEL AND METHOD FOR MANUFACTURING THE SAME

(75) Inventors: Yasuhito Yamaryo, Miyazaki (JP); Yoshiyuki Kaneko, Hachioji (JP); Hiroyuki Tachihara, Ooamishirasato (JP); Takahiro Ueno, Mobara (JP); Takashi Kawasaki, Hitachi (JP); Atsuo Ohtomi, Hikone (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/738,076

(22) PCT Filed: Feb. 19, 2008

(86) PCT No.: PCT/JP2008/052737

§ 371 (c)(1),
(2), (4) Date: May 19, 2010

(87) PCT Pub. No.: WO2009/104246

PCT Pub. Date: Aug. 27, 2009

(65) Prior Publication Data

US 2010/0244687 A1 Sep. 30, 2010

(51) Int. Cl.
*H01J 1/62* (2006.01)

(52) U.S. Cl. ..... 313/587; 313/582

(58) Field of Classification Search ..... 313/582–587
See application file for complete search history.

(56) References Cited

U.S. PATENT DOCUMENTS

2006/0284559 A1 12/2006 Naoi et al.
2007/0126361 A1 6/2007 Lee

FOREIGN PATENT DOCUMENTS

JP 2006-147417 A 6/2006
JP 2007-128894 A 5/2007
JP 2007-149384 A 6/2007

*Primary Examiner* — Vip Patel
(74) *Attorney, Agent, or Firm* — Miles & Stockbridge P.C.

(57) ABSTRACT

It is an object of the present invention to provide a plasma display panel with an improved panel structure for improving a discharge time-lag and, more particularly, to provide a plasma display panel with a new protective film structure, the plasma display panel having uniformed panel properties suitable for mass production with a high yield.

A PDP of the present invention which provides a pair of substrate assemblies opposed to each other sandwiching discharge spaces formed to seal a discharge gas therein, wherein one of the pair of substrate assemblies comprises: display electrodes arranged on a substrate; a dielectric layer for covering the display electrodes; and a protective layer for covering the dielectric layer, the protective layer is configured so that a plurality of MgO single crystals are adhered to an MgO film in such a manner that crystal orientations of the plurality of MgO single crystals are aligned in one direction, and a value which is three times of a standard deviation of coverage factors of the MgO single crystals on the MgO film, divided by a mean value of the coverage factors is 20% or less.

13 Claims, 2 Drawing Sheets

PLASMA DISPLAY PANEL AND METHOD FOR MANUFACTURING THE SAME

TECHNICAL FIELD

The invention relates to a plasma display panel (hereinafter, referred to as PDP) and a method for manufacturing the same.

BACKGROUND ART

At the present, the type of AC-driven PDPs which are generally commercialized is the type of surface discharge PDP. In the type of surface discharge PDP, phosphor layers for color display can be positioned far away in the direction of the thickness of a display panel from a pair of display electrodes, so that the characteristic deterioration of the phosphors due to ion impact during discharging can be reduced. Thus, the type of surface discharge PDP is suitable for prolonging its lifetime rather than another type of opposed discharge PDP where a pair of display electrodes X and Y are formed to a front-side substrate and a rear-side substrate, respectively.

On a front-side substrate in the general type of AC-driven surface discharge PDP, a protective layer is provided for preventing a dielectric layer from being deteriorated by ion impact during discharging, the dielectric layer covering display electrodes X and Y. The protective layer not only prevents the dielectric layer from being deteriorated by ion impact during discharging, but also emits secondary electrons by ion impact thereto and provides a function to make discharge grow.

In general, the protective layer is employed as a thin film of magnesium oxide (MgO) considering high protection from ion impact and good emission capability of secondary electrons.

DISCLOSURE OF THE INVENTION

Problems to be Solved by the Invention

As a protective film of the above-mentioned MgO has a high secondary electron emission coefficient, it is extremely effective to reduce a discharge start voltage. In order to meet a demand for a high-resolution display panel, however, it is necessary to further increase addressing speed, so that a problem of a discharge time-lag newly occurs. That is, it is a big problem how to shorten the discharge time-lag in order to perform a 1080-line scanning within a predetermined frame time period, by a sub-field scanning necessary for gradation display, according to the so-called full-high definition TV standard.

Herein, the discharge time-lag is generally considered to be a sum of a formative time-lag and a statistical time-lag. The formative time-lag is a time interval between the production of initial electron in the display electrodes and the formation of clear discharge, and is regarded approximately as the minimum discharge time when a number of discharges are produced. The statistical time-lag is a time interval between the application of a voltage to the occurrence of ionization up and the start of discharge, and is named because the statistical time-lag approximately causes variations in the case where a number of discharges are repeated. If these discharge time-lags are long, an address (write-in of a display) time also has to be long so as to avoid a mis-display, thereby causing a bad influence that actually a display time may be shorten. Therefore, it is desirable for PDP to make the discharge time-lag short.

As a possible solution to make the discharge time-lag short, conventionally, a technique that MgO single crystals are distributed on the MgO protective film has been proposed, for example, in Japanese Unexamined Patent Application Publication No. 2006-147417. However, conventionally, it has been difficult to uniform the characteristics of the respective panels. The improvement on this respect has been desired.

It is an object of the present invention to provide a plasma display panel with an improved panel structure for improving a discharge time-lag and, more particularly, to provide a plasma display panel with a new protective film structure, the plasma display panel having uniformed panel properties suitable for mass production with a high yield.

Means for Solving the Problems and Effects of the Invention

A PDP of the present invention comprises a pair of substrate assemblies opposed to each other sandwiching discharge spaces formed to seal a discharge gas therein, wherein one of the pair of substrate assemblies comprises: display electrodes arranged on a substrate; a dielectric layer for covering the display electrodes; and a protective layer for covering the dielectric layer, the protective layer is configured so that a plurality of MgO single crystals are adhered to an MgO film in such a manner that crystal orientations of the plurality of MgO single crystals are aligned in one direction, and a value which is three times of a standard deviation of coverage factors of the MgO single crystals on the MgO film, divided by a mean value of the coverage factors is 20% or less.

The principal idea of the present invention is to scatter and distribute the MgO single crystals on the MgO film in such a manner that the crystal orientations of the plurality of MgO single crystals are aligned in one direction. With such a scattering, while the discharge time-lag is improved, the characteristics of the respective panels can be uniformed.

Another feature of the present invention is that a value which is three times of a standard deviation of coverage factors of the MgO single crystals on the MgO film, divided by a mean value of the coverage factors is 20% or less. With this construction, the generation of the lacking in uniformity of the light and dark in the panel during displaying can be prevented.

Besides, the reason why a value which is three times of a standard deviation of the coverage factors, divided by a mean value of the coverage factors is a reference value is as follows.

If it is assumed that a distribution of the coverage factors is a normal probability distribution, 99.73% of all data are included within a mean value$\pm 3\sigma$ when a standard deviation of the coverage factors is represented by $\sigma$. Accordingly, the wideness of the variations of measured values is represented by $3\sigma$. Further, for relative comparison, $3\sigma$ is divided by the mean value for the purpose of representing the wideness of the variations of measured values against the mean value.

In the present invention, the "coverage factor" is defined as a percentage of an area of a surface of the plurality of MgO single crystals against an area of a surface of the underlying MgO protective film when the surface of the MgO protective film, on which the MgO single crystals are scattered and distributed, is vertically observed. The coverage factor is measured at points being 10 or more (for example 10, 11 or 12) lined at an equal distance of 10 mm, and having a field of view of a square of 0.6 mm×0.6 mm. In the present invention, the "standard deviation" means a standard deviation estimated from samples.

A method, whereby a value which is three times of a standard deviation of coverage factors of the MgO single crystals on the MgO film, divided by a mean value of the coverage factors is 20% or less, is not particularly limited, but, as an example, it can be realized that a slurry where a density of MgO single crystals is relatively low is spray-applied onto a MgO film under a high atomizing pressure.

Hereinafter, various embodiments of the present invention will be exemplified.

The intensity of signals at a (200) crystal face after normalization may be the same as or more than the intensity of signals at a (111) crystal face per 1 μm of the MgO film, these signals being X-ray diffraction from the protective layer.

The plurality of MgO single crystals may have a grain size of 0.6 μm or more at 50% of a cumulative percentage in a grain size distribution.

The plurality of MgO single crystals may have a grain size at 10% of a cumulative percentage in a grain size distribution, which is 0.5 times or more of the grain size at 50% of a cumulative percentage.

The surface of the MgO film may have a (111) crystal face, the surface of the MgO single crystals may have a (100) crystal face, and the MgO single crystals may be uniformly scattered and distributed on the MgO film in such a manner that the (100) crystal faces of the MgO single crystals are parallel in unison to the surface of the MgO film, so as to partially cover the (111) crystal face of the MgO film. The MgO single crystals may be uniformly scattered and distributed on the MgO film in such a manner that a crystal face opposed to the (100) crystal faces of the MgO single crystals is in contact with the surface of the MgO film.

It is important that a discharge surface exposed to a gas discharge space has both a superior initial electron emission function and a superior secondary electron emission function in order to improve the discharge time-lag, so that the underlying MgO film is therefore deposited in such a manner that their (111) crystal face is exposed so as to primarily have the secondary electron emission function, and the MgO single crystals are distributed on the MgO film in such a manner that the (100) crystal faces of the MgO single crystals are aligned in the direction of the surface of the MgO film so as to primarily have the initial electron emission function.

The adoption of the new discharge surface as above not only improves a discharge time-lag, but also characteristics of a manufactured panel can be uniformed because the orientations of the MgO single crystals on the underlying MgO film are aligned at the (100) crystal faces. Further, since the contact between the surface of the underlying MgO film and the faces of the MgO single crystals is stable, any problems of partial characteristic changes will not occur, caused by detached and/or removed MgO single crystals.

The mean value of the coverage factors may be from 0.1 to 10%. According to the present invention, even if the coverage factor is relatively low, the generation of the lacking in uniformity of the light and dark in the panel during displaying can be prevented.

In addition, the present invention also provides a method for manufacturing the PDP having the above-mentioned configuration, wherein the MgO single crystals may be adhered on the MgO film by spray-applying a slurry, where a density of the MgO single crystals may be in a range from 0.01 to 2 wt %, onto the MgO film from the upper position under the condition that an atomizing pressure may be 150 kPa or more and 300 kPa or less. According to this method, it may become easy to realize that a value which is three times of a standard deviation of coverage factors of the MgO single crystals on the MgO film, divided by a mean value of the coverage factors is 20% or less.

The various embodiments shown herein may be combined with one another.

EFFECT OF THE INVENTION

The adoption of the new discharge surface as above enables to improve a discharge time-lag. Also, the characteristics of a manufactured panel can be uniformed because the orientations of the MgO single crystals on the underlying MgO film are aligned. Further, since the coverage factors of the MgO single crystals on the underlying MgO film are uniformed, even if the coverage factors are relatively low, the generation of the lacking in uniformity of the light and dark in the panel during displaying can be prevented.

DESCRIPTION OF THE REFERENCE NUMERALS

Figure 1:
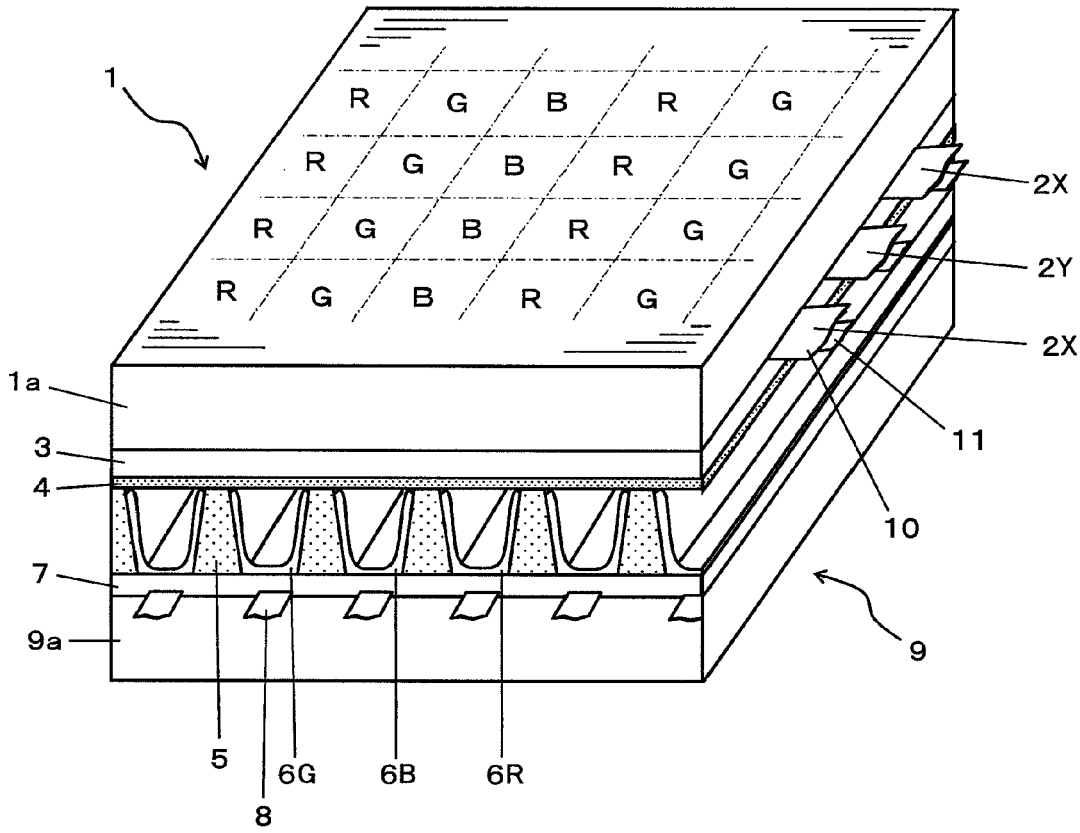
FIG. 1 is a perspective view illustrating a configuration of PDP in accordance with an embodiment of the present invention.

1: front-side substrate assembly
1*a*: front-side substrate
2X, 2Y: display electrodes
3: dielectric layer of the front-side substrate
4: protective layer
4*a*: MgO film
4*b*: MgO single crystals
5: barrier ribs
6R: red phosphor layers
6G: green phosphor layers
6B: blue phosphor layers
7: dielectric layer of the rear-side substrate assembly
8: address electrodes
9: rear-side substrate assembly
9*a*: rear-side substrate
10: transparent electrode
11: bus electrode
21: gas induction tube
22: tank
23: slurry
24: duct
25: pump
26: duct
27: gas induction tube
28: spray gun
29: substrate

BEST MODE FOR CARRYING OUT THE INVENTION

Hereinafter, an embodiment of the present invention will be described by use of the drawings. The contents shown in the drawings and the following description are exemplification, and the scope of the present invention is not limited to the contents shown in the drawings and the following description. Hereinafter, the present invention will be described taking an AC-driven three-electrode surface-discharge PDP for color display as an example.

1. PDP

Figure 2:
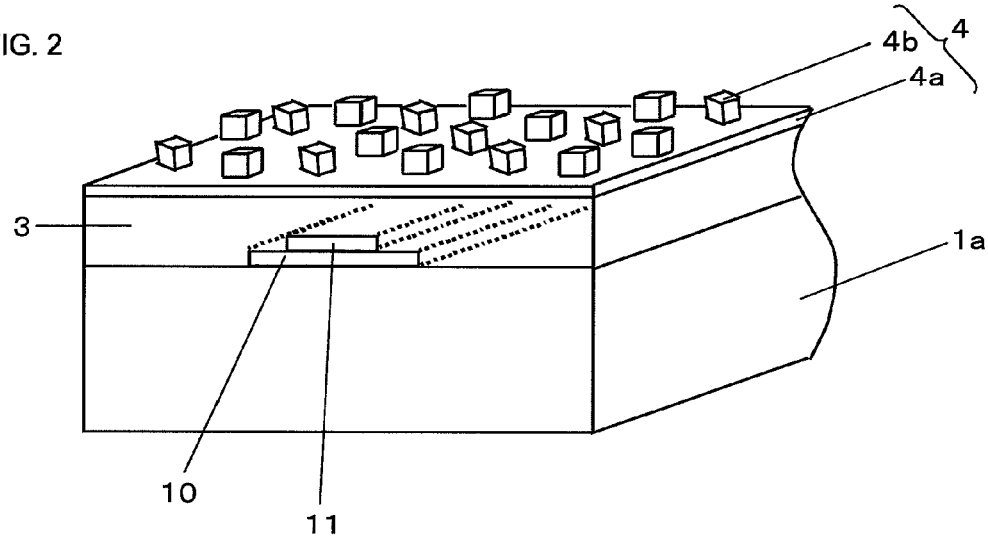
FIG. 2 is an upside-down perspective view of a part of a front side of a substrate assembly shown in FIG. 1.

A PDP in accordance with an embodiment of the present invention will be described with reference to FIGS. 1 and 2. FIG. 1 is a perspective view illustrating a configuration of PDP in accordance with an embodiment of the present invention. FIG. 2 is an upside-down perspective view of a part of a front side of a substrate assembly shown in FIG. 1.

The PDP of this embodiment comprises a front-side substrate assembly 1 and a rear-side substrate assembly 9 opposed to each other sandwiching discharge spaces formed to seal a discharge gas.

The front-side substrate assembly 1 comprises, a plurality of display electrodes 2X and 2Y disposed on a front-side substrate 1*a*, a dielectric layer 3 covering the plurality of display electrodes 2X and 2Y, and a protective layer 4 covering the dielectric layer 3, where the protective layer 4 is configured so that a plurality of MgO single crystals are adhered to an MgO film 4*a* in such a manner that crystal orientations of the plurality of MgO single crystals 4*b* are aligned in one direction.

The rear-side substrate assembly 9 comprises, a plurality of data electrodes 8 disposed on a rear-side substrate 9*a*, a dielectric layer 7 covering a plurality of address electrodes 8 (also called to "data electrodes"), and barrier ribs disposed on the dielectric layer 7 of two outsides of a address electrode 8, and a phosphor layer 6 formed on the surface of the dielectric layer 7 and both side surfaces of the barrier rids 5.

Hereinafter, each of constituent elements will be described in detail.

1-1. Front-Side Substrate, Display Electrodes, Dielectric Layer, Protective Layer (Front-side Substrate Assembly)

A variety of the front-side substrate 1*a* is not particularly limited. For example, the front-side substrate 1*a* is a transparent substrate such as a glass substrate and the like.

In the inner side of the front-side substrate la, there are arranged a plurality of display electrodes 2X and 2Y both horizontally extended and arranged in parallel. Each display line is a space between the neighboring display electrodes 2X and the display electrodes 2Y. This type of PDP is the so-called ALIS structure where the display electrodes 2X and 2Y are equally spaced and all regions between the neighboring electrodes 2X and 2Y become the display lines. The present invention, however, can be applied to another type of PDP where a pair of display electrodes 2X and 2Y is separated by a non-discharge interval (a non-discharge gap).

The display electrodes 2X and 2Y may be composed of a transparent electrode 10 made of materials such as ITO, $SnO_2$ and the like, and a metallic bus electrode 11 made of materials such as Ag, Au, Al, Cu, Cr, and laminates thereof (for example, a Cr/Cu/Cr laminate structure). The display electrodes 2X and 2Y may be formed by a thick film formation technique such as a screen printing method with respect to Ag and Au, and may be formed by a thin film formation technique such as a vapor deposition method or sputtering method, and an etching technique with respect to other metals, so that a predetermined number of display electrodes may be deposited in a predetermined thickness, wideness and interval. The transparent electrode 10 primarily contributes to a discharge activity, which is light transmitting for the user to see the light emission of the phosphor layer from the front-side substrate la. It is preferable that the bus electrode 11 has a low resistance to be able to primarily conduct a current during discharging. Shapes of the transparent electrode 10 and the bus electrode 11 are not particularly limited, and a straight electrode, a T-electrode or a ladder shaped electrode may be employed. The shapes of the transparent electrode 10 and the bus electrode 11 may be similar to or different from each other. For example, the transparent electrode 10 may be the T-electrode or the ladder shaped electrode while the bus electrode 3*b* may be the straight electrode.

The dielectric layer 3 is deposited for covering the display electrodes 2X and 2Y on the display electrodes 2X and 2Y. The dielectric layer 3 can be formed by applying a low melting point glass frit paste onto the front-side substrate 1*a* by a screen printing method, and burning the frit paste. Also, the dielectric layer 3 can be formed by pasting a sheet-like dielectric layer and burning. Furthermore, the dielectric layer 3 may be formed by depositing silicon oxide ($SiO_2$) by a plasma CVD process.

The protective layer 4 is provided on the dielectric layer 3 for protecting the dielectric layer 3 from ion impact due to the discharge during displaying 3. The details of the protective layer 4 will be described later.

1-2. Rear-side substrate, address electrode, dielectric layer, barrier Rib, Phosphor Layer (Rear-side Substrate Assembly)

A variety of the rear-side substrate 9*a* is not particularly limited. For example, the rear-side substrate 9*a* is transparent substrates such as a glass substrate and the like.

On the inner side of the rear-side substrate 9*a*, a plurality of address electrodes 8 are formed horizontally in the crossing direction with the display electrodes 2X and 2Y, and the dielectric layer 7 is formed for covering the data electrodes 8. The address electrodes 8 are provided for forming address discharges to select emission cells at the intersections between the address electrodes 8 and the display electrodes 2Y. The address electrodes 8 may be formed of, for example, a Cr/Cu/Cr laminate structure.

Otherwise, the address electrodes 8 may be composed of metals such as Ag, Au, Al, Cu, Cr and the like. Similarly as the display electrodes 2X and 2Y, the address electrodes 8 may be formed by a thick film formation technique such as a screen printing method with respect to Ag, and Au, and may be formed by a thin firm formation technique such as a vapor deposition method or sputtering method, and an etching technique with respect to other metals, so that a predetermined number of display electrodes may be deposited in a predetermined thickness, wideness and interval.

The dielectric layer 7 of the rear-side substrate can be formed with the same material and by the same method as in the dielectric layer 3 on the front-side substrate 1*a*.

A plurality of barrier ribs 5 are formed on the dielectric layer 7 between the two neighboring address electrodes 8 for partitioning a discharge space. The shape of the barrier ribs 5 in this embodiment is a stripe. The shapes of the barrier ribs 5 may be meander shapes, lattice shapes or ladder shapes.

The barrier ribs 5 may be formed by a sandblasting method or a photo etching method. For example, the barrier ribs 5 can be formed in the sandblasting method by applying a frit paste composed of a glass frit having a low melting point, a binder resin and a solvent onto the dielectric layer 7, drying the frit paste, spraying cutting particles under the condition that a cutting mask having an opening of a pattern of barrier ribs is placed on this frit paste layer, cutting a frit paste layer exposed from the opening of the cutting mask, and further burning it. The barrier ribs 5 can be formed in the photo-etching method using a photosensitive resin as the binder resin and then exposure and development using a mask, and burning it, in place of cutting with the cutting particles.

At the sides and the bottom of the discharge space partitioned by the barrier ribs 5, phosphor layers 6R, 6G and 6B of red (R), green (G) and blue (B), respectively, are formed. The phosphor layers 6R, 6G and 6B can be formed by applying a phosphor paste containing a phosphor powder, a binder resin and a solvent to the discharge space partitioned by the barrier ribs 5 by a screen printing method or a method of using a dispenser, repeating this application for every color (R, G, B), and burning it.

It is possible that the phosphor layers 6R, 6G and 6B may be formed by using a sheet-like phosphor layer material (the so-called green sheet) containing a phosphor powder, a photosensitive material and a binder resin, and using a photolithography technique. In this case, a predetermined color sheet may be adhered to the display area of the substrate, and this may be light exposed and developed, repeatedly, by the number of the respective colors, so that the phosphor layers 6 of the respective colors may be formed between the corresponding barrier ribs 5.

The above-mentioned front-side substrate assembly 1 and rear-side substrate assembly 9 are confronted so that the display electrodes 2X and 2Y cross the address electrodes 8, and the surroundings are sealed to finalize a PDP by fulfilling a discharge gas containing a Ne gas as a main component and Xe within the discharge space surrounded by the barrier ribs 5. In this type of PDP, a discharge space at the intersections between the display electrodes (2X and 2Y) and the address electrodes 8, is a single cell (unit emission region) defined as a minimum unit of display. A single pixel comprises three cells of R, G and B.

1-3. Protective Layer

The protective layer 4 as the primary feature of the present invention will be next described in detail. The protective layer 4 is configured so that a plurality of MgO single crystals 4*b* are adhered to an MgO film 4*a* in such a manner that crystal orientations of the plurality of MgO single crystals 4*b* are aligned in one direction.

The MgO film 4*a* can be formed by a thin film formation process, known in this field, such as electron beam deposition method or sputtering.

The MgO single crystals 4*b* may be made of MgO only or otherwise may contain a small amount of another ingredient (such as the residue of flux) in such an amount not to influence the crystal structure. The MgO single crystals 4*b* are cubical crystals where all the crystal faces are equivalent with respect to the physical and chemical properties. Therefore, when the plurality of MgO single crystals 4*b* are adhered on the MgO film 4*a* so that any crystal surface of the MgO single crystals 4*b* is adhered to the surface of the MgO film 4*a*, the crystal orientations of the plurality of MgO single crystals 4*b* are also aligned in one direction. In other words, the crystal orientations of the plurality of MgO single crystals 4*b* are aligned in one direction unless obstacle such as fine grains interposed between the crystal surfaces of the MgO single crystals 4*b* and the MgO film 4*a*. The phrase, "the crystal orientations are aligned in one direction" means that directions of normal lines of crystal faces of cubical crystals are aligned in one direction. As long as the directions are aligned in one direction, it is no matter that the cubical crystals may be turned around the normal lines.

Here, microscopically, the surface of the underlying MgO film 4*a* deposited by the electron beam deposition method has an uneven column crystal structure, and fine spaces between summits of column crystals. Therefore, if an interval between the summits is shorter than a diameter of the MgO single crystal to be adhered, the underlying MgO film can be substantially flat, so that the crystal orientations of the MgO single crystals will be conveniently aligned. In other words, if many MgO single crystals, whose diameter is shorter than twice of the interval between the summits of the column crystals of the underlying MgO film, are present, the MgO single crystals will tilt and slip into the fine spaces between the summits, and therefore the crystal orientations of the MgO single crystals will not be aligned.

In view of the above, according to the present invention, a grain size of the plurality of MgO single crystals 4*b* at 50% of a cumulative percentage in a grain size distribution, is preferably 0.6 μm or more, and more preferably 0.9 μm or more. That is, as technical requirements to align the crystal orientations, it is necessary that the diameter of each of the MgO single crystals that occupy more than a half of a unit volume is 0.6 μm or more, and preferably 0.9 μm or more, and more preferably 1.3 μm or more. If the diameters are too small, as stated above, the edges of the MgO single crystals 4*b* may slip into the fine spaces of the surface of the MgO film 4*a*, so that, preferably, the diameters of the MgO single crystals being shorter than 0.1 μm are excluded. In addition, preferably, the grain size of the MgO single crystals 4*b* at 50% of a cumulative percentage is 30 μm or less. If the diameters are too large, the exposure areas of the underlying MgO film having the secondary electron emission function become narrow to thereby increase the discharge voltage. The grain size distribution of the plurality of MgO single crystals 4*b* can be measured using a particle size distribution analyzer of the laser diffraction type.

The grain size of the plurality of the MgO single crystals 4*b* at 50% of a cumulative percentage in the grain size distribution may be specifically, for example, 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 4, 5, 10, 15, 20, 25, or 30 μm. The grain size of the plurality of the MgO single crystals 4*b* at 50% of a cumulative percentage may be in a range between any two of numerals exemplified above.

The grain size of the plurality of the MgO single crystals 4*b* at 10% of a cumulative percentage in the grain size distribution is not particularly limited but, preferably, 0.5 times or more of the grain size at 50% of a cumulative percentage. In this case, a percentage of fine MgO single crystals in the plurality of MgO single crystals 4*b* is low. The fine MgO single crystal is interposed between the crystal surface of larger MgO single crystal 4*b* and the MgO film 4*a* to thereby interfere the contact between the crystal surface of the MgO single crystal 4*b* and the MgO film 4*a*, so that the crystal orientations of the MgO single crystals 4*b* are prevented from being aligned. If the grain size of the plurality of the MgO single crystals 4*b* at 10% of a cumulative percentage is 0.5 times or more of the grain size at 50% of a cumulative percentage, the percentage of the fine MgO single crystals 4*b* in the MgO single crystals is too low so that the alignment of the crystal orientations of the MgO single crystals 4*b* is easy.

The grain size of the plurality of the MgO single crystals 4*b* at 10% of a cumulative percentage in the grain size distribution may be specifically, for example, 0.5, 0.55, 0.6, 0.65, 0.7, 0.75, 0.8, 0.85, 0.9, or 0.95 times of the grain size at 50% of a cumulative percentage. The grain size of the plurality of the MgO single crystals 4*b* at 10% of a cumulative percentage may be in a range between any two of numerals exemplified above or more than any one number exemplified above. As the grain size of the plurality of the MgO single crystals 4*b* at 10% of a cumulative percentage is closer to the grain size of the plurality of the MgO single crystals 4*b* at 50% of a cumulative percentage, the alignment of the crystal orientations of the MgO single crystals 4*b* becomes easier.

Whether the crystal orientations of the plurality of MgO single crystals 4*b* are aligned can be determined based on the ratio between the signal intensity at a crystal face of (200) and that at a crystal face of (111) using an X-ray diffraction (XRD). The crystal face of (200) of the MgO single crystals is equivalent with that of the crystal face of (100). The signal intensity at the crystal face of (200) is strong when the crystal orientations of the plurality of MgO single crystals 4*b* are aligned and the signal intensity at the crystal face of (200) is very weak when the crystal orientations of the plurality of MgO single crystals 4*b* are not aligned. On the other hand, the signals at the crystal face of (111) are primarily the signals from the MgO film 4*a* and they rarely depend upon whether the crystal orientations of the plurality of MgO single crystals 4*b* are aligned. Accordingly, the value of the ratio of {[the signal intensity at a crystal face of (200)] over [the signal intensity at a crystal face of (111)]} indicates whether the crystal orientations of the plurality of MgO single crystals 4*b* are aligned or not. As an example, if the signal intensity at a crystal face of (200) after normalization is more than one time the signal intensity at the crystal face of (111) per 1 μm of the MgO film, it can be determined that the crystal orientations of the plurality of MgO single crystals 4*b* are aligned. Here, the "normalization" means that a measured value of the signal intensity at a crystal face of (200) is multiplied by 0.116 with the signal intensity at the crystal face of (111) being a reference, considering that the ratio of the measured signal intensity between the crystal face of (200) and the crystal face of (111) is 11.6/100 when the existence ratio between the crystal face of (200) and the crystal face of (111) is 1/1.

The production method of the MgO single crystals 4*b* is not particularly limited but, as an example, MgO seed crystals manufactured by a gas phase method and a small amount of flux (accelerant) are mixed and burned so that a burned product is then pulverized. Since the MgO seed crystals manufactured by the gas phase method are small in size and large in size variations, the crystal orientations of the MgO seed crystals cannot be aligned even if the MgO seed crystals manufactured by the gas phase method are as such scattered on the MgO film 4*a*. On the other hand, the MgO single crystals 4*b* manufactured above are large in size and small in size variations. Then, if the MgO single crystals 4*b* manufactured above are scattered on the MgO film 4*a*, the crystal orientations of the plurality of MgO single crystals 4*b* can be aligned. The flux may be employed by a halide of magnesium (magnesium fluoride, etc.).

For example, burning is performed at the temperature of 1000 to 1700° C. for 1-5 hours. In general, the sizes of the MgO single crystals 4*b* become larger as the burning temperature is higher, the burning period is longer, and the amount of the flux is more. Since the sizes of the MgO single crystals 4*b* are smaller and the speed of the crystal growth during the burning is faster, the variations in the sizes of the MgO single crystals 4*b* become smaller as the burning temperature is higher, the burning period is longer, and the amount of the flux is more. Thus, in order to be a desired grain size distribution of the MgO single crystals 4*b*, the burning temperature, the burning period and the amount of the flux are suitably controlled. The burning temperature may be, for example, 1000, 1100, 1200, 1300, 1400, 1500, 1600 or 1700° C. The burning temperature may be in a range between any two of numerals exemplified above. The burning period may be, for example, 1, 2, 3, 4 or 5 hours. The burning period may be in a range between any two of numerals exemplified above. The amount of the flux may be, for example, 0.01-0.1 wt % and, specifically, for example, 0.001, 0.002, 0.005, 0.01, 0.02, 0.03, 0.04, 0.05, 0.06, 0.07, 0.08, 0.09 or 0.1 wt %. The amount of the flux may be in a range between any two of numerals exemplified above. The method of pulverizing the burned product is not particularly limited but, as an example, the burned product is placed within a mortar to pulverize it with a pestle into powder.

The production of the MgO seed crystals by the gas phase method may be carried out specifically, for example, by a method described in Japanese Unexamined Patent Application Publication No. 2004-182521 and/or a method described in "Synthesis of Magnesia Powder by Gas Phase Method and Its Properties" in "Material" Vol. 36, No. 410, pp. 1157-1161, on November (1987). Further, the MgO seed crystals manufactured by the gas phase method may be bought from Ube Material Industries, Ltd.

A value which is three times of a standard deviation of coverage factors of the MgO single crystals on the MgO film, divided by a mean value of the coverage factors is 20% or less. In such a case, the variations in a surface of the display can be prevented, and the lacking in uniformity of the light and dark in the panel during displaying can be prevented.

In more detail, for example, the value which is three times of a standard deviation of the coverage factors, divided by a mean value of the coverage factors may be 0, 1, 5, 10, and 20%. The value which is three times of a standard deviation of the coverage factors, divided by a mean value of the coverage factors may be in a range between any two of numerals exemplified above.

If the mean value of the coverage factors is more than 10%, impurities to be absorbed by the protective film 4 from the atmosphere may be increased so that the green fluorescent element may be deteriorated by the absorbed impurities and the green emission light may become weak, whereby the red color is increased in the color of the display. The so-called lacking in uniformity of the red color in the panel may be significant.

For this reason, it is desirable that the mean value of the coverage factors may be 10% or less (for example, 0.1 to 10%). More specifically, for example, it may be 0.1, 0.3, 0.5, 1, 1.5, 2, 2.5, 3, 4, 5, and 10%. The mean value of the coverage factors may be in a range between any two of numerals exemplified above.

1-4. Method for Producing Protective Layer

A production method of the protective layer 4 is not particularly limited but, as an example, the protective layer 4 may be produced so that a plurality of MgO single crystals 4*b* are adhered to an MgO film 4*a* in such a manner that a value which is three times of a standard deviation of coverage factors of the MgO single crystals on the MgO film, divided by a mean value of the coverage factors is 20% or less.

A method of adhering the MgO single crystals 4*b* onto the MgO film 4*a* is not particularly limited. As an example, the MgO single crystals may be adhered on the MgO film by spray-applying a slurry, where a density of the MgO single crystals is in a range of 0.01 to 2 wt %, onto the MgO film from the upper position under the condition that an atomizing pressure is 150 kPa or more and 300 kPa or less. Thus, anyway, the MgO single crystals 4*b* can be adhered to the entire regions or a portion of the MgO film 4*a*.

A disperse medium of the slurry is not particularly limited, but, preferably, it may be a compound having a molecular structure of high polarity such as hydroxyl group, carbonyl group, and nitrile group, and effecting no influence on the MgO single crystals, and more preferably, it may be alcohol such as 2-propanol (isopropyl alcohol, IPA).

The density of the MgO single crystals 4*b* in the slurry may be in a range from 0.01 to 2 wt %. This is because the density in the slurry may be too thick to uniformly spray-apply the slurry since the MgO single crystals 4*b* may be agglomerated in a drop atomized during the spray-application. Specifically, for example, the density of the MgO single crystals 4*b* may be 0.01, 0.05, 0.1, 0.2, 0.3, 0.4, 0.5, 0.6, 0.7, 0.8, 0.9, 1.0, 1.5, and 2 wt %. The density of the MgO single crystals 4*b* may be in a range between any two of numerals exemplified above.

Figure 3:
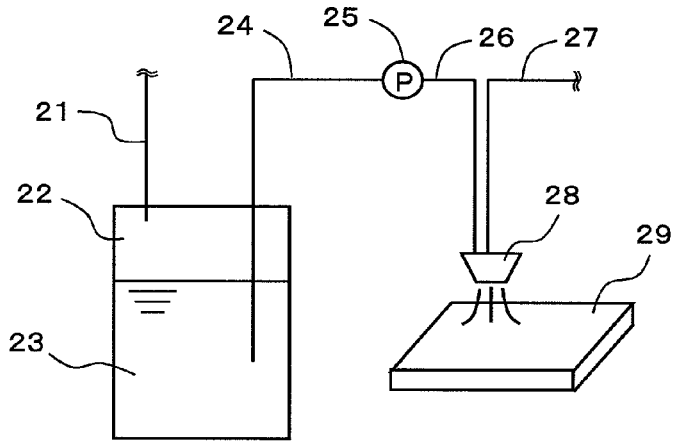
FIG. 3 is a schematic view of a spray-application device suitable for manufacturing a protective film of PDP in accordance with an embodiment of the present invention.

The slurry may be spray-applied using, as an example, a spray-application device as shown in FIG. 3. In the spray-application device of FIG. 3, the above slurry 23 contained within a tank 22 is moved to a spray gun 28 through ducts 24 and 26 by an operation of a pump 25, and discharged toward a substrate 29 from the spray gun 28. Instead of moving the slurry 23 by the operation of the pump 25, the slurry 23 may be pressured owing to the pressure of a gas such as air or nitrogen gas through a gas introduction tube provided on the tank 22, and moved to the spray gun 28 with the pressure.

As the spray gun 28, the so-called 2-fluid air-atomizing system is used which may discharge the slurry and the air both atomized in a fluid condition. The pressure of the air for atomizing the slurry, the so-called atomizing pressure, becomes high so that the drop of the atomized slurry may become fine and the MgO single crystals 4*b* in the drop may be prevented from being agglomerated.

Further, since the drop of the atomized slurry becomes fine, a solvent may be vaporized immediately after the drop reaches the MgO film 4*a*. The MgO single crystals 4*b* may be prevented from agglomeration caused by combining the drops with each other before the solvent may be vaporized after the reach of the drop to the MgO film 4*a*. Thus, the MgO single crystals 4*b* can be scattered and distributed so that the coverage factors of the MgO single crystals 4*b* upon the MgO film 4*a* can be uniformed.

Besides, if the atomizing pressure is too high, the drop may become too fine so that the solvent may be vaporized before the reach of the drop to the MgO film 4*a*. And, then, the MgO single crystals 4*b* cannot be adhered upon the MgO film 4*a*.

In view of the above, in order to scatter and distribute the MgO single crystals 4*b* so that the coverage factors of the MgO single crystals 4*b* upon the MgO film 4*a* are uniformed, preferably, the atomizing pressure to be applied to the spray gun may be 150 kPa or more and 300 kPa or less. Specifically, for example, it may be 150, 160, 170, 180, 190, 200, 210, 220, 230, 240, 250, 300 kPa. The atomizing pressure may be in a range between any two of numerals exemplified above.

2. Experiment for Proving Effect of Present Invention

In the following experiment for proving an effect of the present invention, the improvement effect of the present invention was investigated by comparing the lacking in uniformity of the light and dark in the panel during displaying between one case where a value which is three times of a standard deviation of coverage factors of the MgO single crystals on the MgO film, divided by a mean value of the coverage factors is 20% or less and the other case where this is more than 20%.

2-1. Method for Producing MgO Single Crystals

The MgO single crystals 4*b* were prepared by the following method.

First, $MgF_2$ (produced by Furuuchi Chemical Corporation, purity: 99.99%) were added as a flux by 48 ppm to MgO seed crystals (produced by Ube Material Industries, Ltd., trade name: HIGH PURITY & ULTRAFINE SINGLE CRYSTAL MAGNESIA POWDER (2000A)). This powder was mixed and milled with a mortar and a pestle.

Next, after the mixture and the milling, the resulting mixture was burned at 1450° C. for 1 hour in the air.

Next, the burned substance was pulverized into powder with a mortar and a pestle to obtain the MgO single crystals 4*b*.

Here, a grain size distribution of the obtained MgO single crystals 4*b* was measured using a particle size distribution analyzer of the laser diffraction type (model: HELOS & RODOS, produced by SYSMPATEC INC). As a result, a grain size at 10% of cumulative percentage, a grain size at 50% of cumulative percentage and a grain size at 90% of cumulative percentage were 0.8 μm, 1.2 μm and 2.1 μm, respectively. The grain size at 10% of cumulative percentage was 0.67 times the grain size at 50% of cumulative percentage, so that it was evident that the obtained MgO single crystals 4*b* contained a small amount of fine grains.

2-2. Method for Manufacturing PDP

Next, a PDP where the plurality of MgO single crystals 4*b* were adhered on the MgO film 4*a* so that the crystal orientations of the plurality of MgO single crystals 4*b* were aligned in one direction was manufactured according to the following method.

2-2-1. General Outline

As shown in FIG. 1, a front-side substrate assembly 1 was prepared by forming display electrodes 2X and 2Y, a dielectric layer 3, and a protective layer 4 (a plurality of MgO single crystals 4*b* were adhered on a MgO film 4*a* so that the crystal orientations of the plurality of MgO single crystals 4*b* were aligned in one direction) on a front-side substrate 1*a* made of glass. Further, a rear-side substrate assembly 9 was prepared by forming address electrodes 8, a dielectric layer 7, barrier ribs 5, and phosphor layers 6G, 6B and 6R on a rear-side substrate 9*a* made of glass. Next, a panel having internal air-tight discharge spaces was prepared by overlaying the front-side substrate assembly 1 on the rear-side substrate assembly 2 and sealing these assemblies at their peripheral portions with a sealing material. Next, after evacuating the air in the discharge spaces, a discharge gas was introduced into the discharge spaces to complete a PDP.

2-2. Method of Adhering the MgO Single Crystals 4*b* to the MgO Film 4*a*

The MgO single crystals 4*b* were adhered to the MgO film 4*a* according to the following method.

First, the MgO single crystals 4*b* were mixed in the rate of 2 gram with respect to 1 litter with IPA (produced by KANTO CHEMICAL Co., Inc, for the electronics industry), and the resulting mixture was dispersed with an ultrasonic dispersing machine and thereby the agglomerated crystals were dispersed to prepare slurry.

Next, the above-mentioned slurry was spray-applied onto the MgO film 4*a* with a coating spray gun so as to adhere the MgO single crystals 4*b* to the MgO film 4*a*. As the spray gun, a 2-fluid air-atomizing system was used. The density of the MgO single crystals 4*b* in the slurry and the atomizing pressure applied to the spray gun were set as tabled in Table 1. The MgO single crystals 4*b* were adhered to the MgO film 4*a* so that the density of the MgO single crystals 4*b* was 0.1 g per 1 $m^2$ of the film.

TABLE 1

| | density of MgO single crystals | atomizing pressure |
|---|---|---|
| Embodiment | 0.6 wt % | 180 kPa |
| Comparison | 0.2 wt % | 60 kPa |

After the MgO single crystals 4*b* were adhered to the MgO film 4*a*, coverage factors were measured using a microscope. The magnifying power of the microscope was 10, and the field of view was a square of 0.6 mm×0.6 mm. The coverage factors were measured at three directionally-aligned points at 0 degree, 45 degrees and 90 degrees, respectively, to the bus electrode 11, the points at each direction being 12 at a distance of 10 mm.

Using the coverage factors measured, a value which is three times of a standard deviation of coverage factors, divided by a mean value of the coverage factors was calculated. Tables 2 to 4 show the results.

TABLE 2

| | Measured point | Embodiment | Comparison |
|---|---|---|---|
| Coverage factors at the measured points | 0 mm | | |
| | 10 mm | 1.82% | 1.19% |
| | 20 mm | 1.59% | 1.09% |
| | 30 mm | 1.94% | 1.08% |
| | 40 mm | 1.69% | 1.16% |
| | 50 mm | 1.58% | 1.23% |
| | 60 mm | 1.76% | 0.96% |
| | 70 mm | 1.80% | 0.88% |
| | 80 mm | 1.85% | 0.93% |
| | 90 mm | 1.65% | 0.95% |
| | 100 mm | 1.77% | 1.32% |
| | 110 mm | 1.66% | 1.03% |
| Mean value of coverage factors | | 1.74% | 1.07% |
| Value which is three times of a standard deviation/mean value of coverage factors | | 20% | 39% |

TABLE 3

| 45 degrees | | | |
|---|---|---|---|
| | Measured point | Embodiment | Comparison |
| Coverage factors at the measured points | 0 mm | 1.85% | 1.26% |
| | 10 mm | 1.74% | 1.17% |
| | 20 mm | 1.68% | 1.23% |
| | 30 mm | 1.71% | 1.15% |
| | 40 mm | 1.76% | 1.13% |
| | 50 mm | 1.49% | 1.19% |
| | 60 mm | 1.82% | 0.70% |
| | 70 mm | 1.67% | 1.08% |
| | 80 mm | 1.58% | 1.24% |
| | 90 mm | 1.74% | 1.19% |
| | 100 mm | 1.70% | 1.35% |
| | 110 mm | 1.68% | 1.45% |
| Mean value of coverage factors | | 1.70% | 1.18% |
| Value which is three times of a standard deviation/mean value of coverage factors | | 17% | 46% |

TABLE 4

| 90 degrees | | | |
|---|---|---|---|
| | Measured point | Embodiment | Comparison |
| Coverage factors at the measured points | 0 mm | 1.76% | 1.09% |
| | 10 mm | 1.66% | 1.17% |
| | 20 mm | 1.66% | 1.17% |
| | 30 mm | 1.71% | 1.22% |
| | 40 mm | 1.68% | 1.18% |
| | 50 mm | 1.66% | 1.23% |
| | 60 mm | 1.62% | 1.21% |
| | 70 mm | 1.77% | 1.01% |
| | 80 mm | 1.65% | 1.18% |
| | 90 mm | 1.66% | 1.22% |
| | 100 mm | 1.89% | 1.27% |
| | 110 mm | 1.50% | 1.44% |
| Mean value of coverage factors | | 1.69% | 1.20% |
| Value which is three times of a standard deviation/mean value of coverage factors | | 17% | 26% |

With reference to Tables 2 to 4, in the comparisons, a value which is three times of a standard deviation of coverage factors, divided by a mean value of the coverage factors was 39% in the direction of 0 degree to the bus electrode 11, 46% in the direction of 45 degrees to the bus electrode 11, and 26% in the direction of 90 degrees to the bus electrode 11, respectively. In contrast to this, in the embodiments, the same was 20% in the direction of 0 degree to the bus electrode 11, 17% in the direction of 45 degrees to the bus electrode 11, and 17% in the direction of 90 degrees to the bus electrode 11, respectively.

2-2-3. Others

Other conditions were as follows.

Front-side substrate assembly 1:

Width of the transparent electrodes 10: 270 μm

Width of the bus electrodes 11: 95 μm

Width of the discharge gap: 100 μm

The dielectric layer 3: formed by applying a glass paste having a low melting point and burning the paste, thickness: 30 μm The MgO film 4*a*: the MgO layer by electron beam evaporation, thickness: 1.1 μm Rear-side substrate assembly 9:

Width of the address electrodes 8: 70 μm

The dielectric layer 7: formed by applying a glass paste having a low melting point and burning the paste, thickness: 10 μm Thickness of a portion of the phosphor layers 6G, 6B and 6R, directly above the address electrodes 8: 20 μm Height of the barrier ribs 5: 140 μm Width at a top portion of the barrier ribs 5: 50 μm Pitch of the barrier ribs 5: 360 μm The discharge gas: Ne 96%-Xe 4%, 500 Torr 2-3. Lighting Test Lighting tests of the manufactured PDPs were investigated to evaluate the lacking in uniformity of the light and dark in the panel during displaying. Table 5 shows the results of the lighting tests. The lacking in uniformity of the light and dark in the panel during displaying was checked visually.

TABLE 5

| | lacking in uniformity of the light and dark |
|---|---|
| Embodiment | NO |
| Comparison | YES |

With reference to Table 5, it is seen that the embodiment can improve the lacking in uniformity of the light and dark in the panel during displaying. The results represent that the PDP, where the MgO crystals were adhered to the MgO film in such a manner that a value which is three times of a standard deviation of coverage factors, divided by a mean value of the coverage factors is 20% or less, can provide good discharge properties because the plurality of MgO single crystals 4*b* are uniformly adhered to the MgO film 4*a*.

Further, as shown in the related experiment as described below, since the MgO single crystals are scattered and distributed on the MgO film in such a manner that the crystal orientations of the plurality of MgO single crystals are aligned in one direction, the discharge time-lag is significantly improved.

As described above, according to the present invention, it was investigated that the PDP having both the significantly improved discharge time-lag and the significant improvement of the lacking in uniformity of the light and dark was provided.

3. Related Experiment

Next, using the MgO single crystals 4*b* produced with the method as described in "2-1. Method for producing MgO single crystals", the MgO single crystals 4*b* are scattered and distributed on the MgO film 4*a* in such a manner that the crystal orientations of the plurality of MgO single crystals are aligned in one direction. Thus, the discharge time-lag is significantly improved. This improvement is investigated by the related experiment as described below.

Basically, the PDP for the related experiment was manufactured with the method as described in "2-2. Method for manufacturing PDP" as above, except that the MgO single crystals 4*b* were adhered on the MgO film 4*a* as described below. A discharge time-lag test was performed after the PDP was thus manufactured.

A detailed explanation will be described below.

3-1. Method of Adhering the MgO Single Crystals 4*b* to the MgO Film 4*a*

First, the MgO single crystals 4*b* were mixed in the rate of 2 gram with respect to 1 litter with IPA (produced by KANTO CHEMICAL Co., Inc, for the electronics industry), and the resulting mixture was dispersed with an ultrasonic dispersing machine and thereby the agglomerated crystals were dispersed to prepare slurry.

Next, the above-mentioned slurry was spray-applied onto the MgO film 4*a* with a coating spray gun, and then this coat was dried by blowing a dry air. This step was repeated by several times to adhere the MgO single crystals 4*b* to the MgO film 4*a*. As the spray gun, a 2-fluid air-atomizing system was used. The atomizing pressure applied to the spray gun was 60 kPa. The MgO single crystals 4*b* were adhered to the MgO film 4*a* so that the density of the MgO single crystals 4*b* was 0.3 g per 1 $m^2$ of the film.

Figure 4:
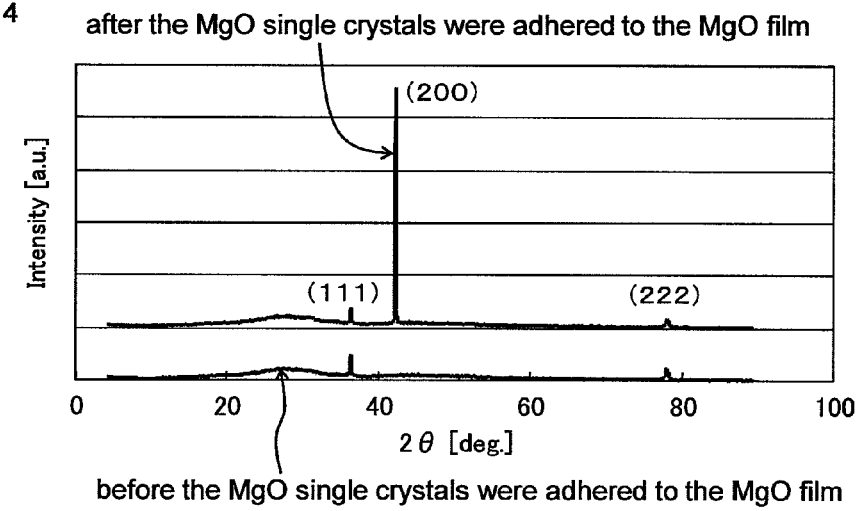
FIG. 4 is a graph showing X-ray diffraction pattern in an experiment related to the present invention.

Before and after the MgO single crystals 4*b* were adhered to the MgO film 4*a*, the ratios of the signal intensity were measured using an X-ray diffraction (XRD). FIG. 4 shows a graph of the measurement results.

With reference to FIG. 4, before the MgO single crystals 4*b* were adhered to the MgO film 4*a*, the signals at a crystal face of (111) and at a crystal face of (222) were observed and after the MgO single crystals 4*b* were adhered to the MgO film 4*a*, the signals at a crystal face of (111), at a crystal face of (222) and, in addition, at a crystal face of (200) were observed.

The signal intensity at the crystal face of (111) and at the crystal face of (222) was unchanged before and after the MgO single crystals 4*b* were adhered to the MgO film 4*a*. The signal intensity at the crystal face of (200) after normalization was 1.9 times the signal intensity at the crystal face of (111) per 1 μm of the MgO film. These results indicated that the crystal orientations of the plurality of MgO single crystals 4*b* were aligned in one direction.

Another measurement using the X-ray diffraction (XRD) was performed with respect to another PDP where the MgO seed crystals were adhered on the MgO film 4*a* by the same method. As a result, the signal intensity at the crystal face of (200) was very small and the signal intensity at the crystal face of (200) after normalization was less than 0.5 times the signal intensity at the crystal face of (111) per 1 μm of the MgO film.

Before and after the MgO single crystals 4*b* were adhered to the MgO film 4*a*, the gloss level was measured to calculate the changing rate of gloss levels. The gloss level was measured using a glossmeter (a handy glossmeter IG-331 manufactured by HORIBA LTD.) at a measurement angel of 60 degrees.

As a result, the changing rate of gloss levels was 30%. This value was considered to be about 6%, being converted into coverage factor of the MgO single crystals 4*b* on the surface of the MgO film 4*a*.

3. Discharge Time-Lag Test

Next, a discharge time-lag test was performed on each PDP manufactured.

Figure 5:
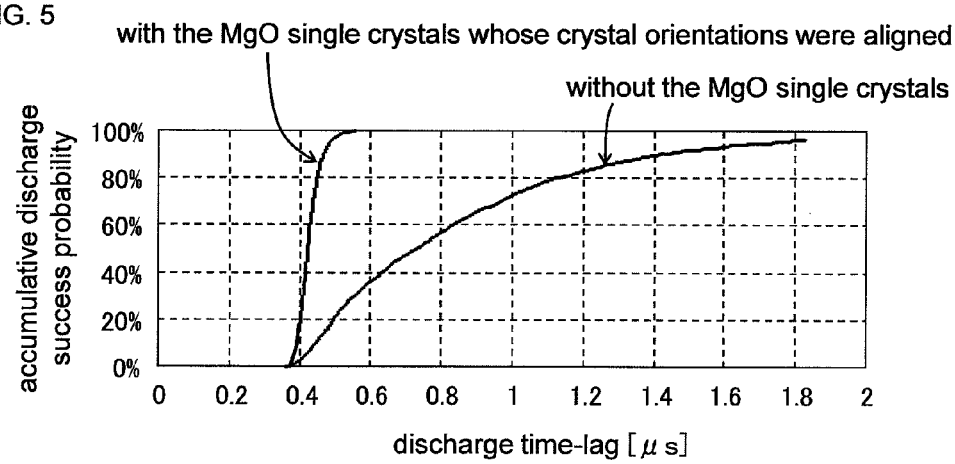
FIG. 5 shows a graph of a cumulative probability of discharge versus a discharge time-lag in the experiment related to the present invention.

In a discharge time-lag test, when a voltage was applied to the address electrodes 8, an interval was measured between the time of the voltage application and the actual starting time of the discharge. The interval of time was measured by 1000 times. FIG. 5 shows the relationship between the discharge time-lag and the cumulative probability of the discharge.

FIG. 5 shows the results between one case where the plurality of MgO single crystals 4*b*, whose crystal orientations were aligned, were adhered to the MgO film 4*a*, and another case where the plurality of MgO single crystals 4*b* were not adhered to the MgO film 4*a*. With reference to FIG. 5, it was seen that the former case improved the discharge time-lag. This results indicated that a PDP comprising a protective layer 4 in which the plurality of MgO single crystals 4*b* were adhered on the MgO film 4*a* so that the crystal orientations of the plurality of MgO single crystals 4*b* were aligned in one direction, improved discharge properties such as the discharge time-lag and provides good discharge properties.

As described above, using the MgO single crystals 4*b* produced with the method as described in "2-1. Method for producing MgO single crystals", the MgO single crystals 4*b* were scattered and distributed on the MgO film 4*a* in such a manner that the crystal orientations of the plurality of MgO single crystals were aligned in one direction. Thus, it was investigated that the discharge time-lag was significantly improved.

In the embodiments described above, the invention is described by exemplifying the type of three electrode surface-discharge PDP comprising a pair of display electrodes on a front-side substrate and address electrodes on a rear-side substrate, but the invention is not limited to such a type and can also be applied to another type of three electrode surface-discharge PDP comprising a pair of display electrodes and address electrodes on a front-side substrate, where the display electrodes are arranged on an insulator layer formed on the address electrodes, and a dielectric layer and a protective layer are provided on the display electrodes. In addition, the present invention can be applied to a further type of AC-driven two opposing electrode discharge PDP comprising a pair of display electrodes X and Y respectively formed on opposing substrates.

INDUSTRIAL APPLICABILITY

The application of the present invention can permit the reduction of display failure due to the lacking in uniformity of the light and dark in the panel during displaying as well as the improvement of a discharge time-lag. The PDP can be enabled to be mass produced with a high yield. Therefore, the PDP according to the present invention is useful for providing good display at a low cost, advantageously.

The invention claimed is:

1. A plasma display panel which provides a pair of substrate assemblies opposed to each other sandwiching discharge spaces formed to seal a discharge gas therein, wherein one of the pair of substrate assemblies comprises:

display electrodes arranged on a substrate; a dielectric layer for covering the display electrodes; and a protective layer for covering the dielectric layer, the protective layer is configured so that a plurality of MgO single crystals are adhered to an MgO film in such a manner that crystal orientations of the plurality of MgO single crystals are aligned in one direction, and a value which is three times of a standard deviation of coverage factors of the MgO single crystals on the MgO film, divided by a mean value of the coverage factors is 20% or less.

2. The plasma display panel according to claim 1, wherein the intensity of signals at a (200) crystal face after normalization is the same as or more than the intensity of signals at a (111) crystal face per 1 μm of the MgO film, these signals being X-ray diffraction from the protective layer.

3. The plasma display panel according to claim 1, wherein the plurality of MgO single crystals have a grain size of 0.6 μm or more at 50% of a cumulative percentage in a grain size distribution.

4. The plasma display panel according to claim 2, wherein the plurality of MgO single crystals have a grain size at 10% of a cumulative percentage in a grain size distribution, which is 0.5 times or more of the grain size at 50% of a cumulative percentage.

5. The plasma display panel according to claims 1, wherein a surface of the MgO film has a (111) crystal face; a surface of the MgO single crystals has a (100) crystal face; and the MgO single crystals are uniformly distributed on the MgO film in such a manner that the (100) crystal faces of the MgO single crystals are parallel in unison to the surface of the MgO film, so as to partially cover the (111) crystal face of the MgO film.

6. The plasma display panel according to claim 5, wherein the MgO single crystals are uniformly distributed in such a manner that a crystal face opposite to the (100) crystal face of the MgO single crystals is in contact with the surface of the MgO film.

7. The plasma display panel according to claim 1, wherein the mean value of the coverage factors is in a range from 0.1 to 10%.

8. A method for manufacturing the plasma display panel according to claim 1, wherein the MgO single crystals are adhered on the MgO film by spray-applying a slurry, where a density of the MgO single crystals is in a range from 0.01 to 2 wt %, onto the MgO film from the upper position under the condition that an atomizing pressure is 150 kPa or more and 300 kPa or less.

9. The plasma display panel according to claim 2, wherein the plurality of MgO single crystals have a grain size of 0.6 μm or more at 50% of a cumulative percentage in a grain size distribution.

10. The plasma display panel according to claim 2, wherein a surface of the MgO film has a (111) crystal face; a surface of the MgO single crystals has a (100) crystal face; and the MgO single crystals are uniformly distributed on the MgO film in such a manner that the (100) crystal faces of the MgO single crystals are parallel in unison to the surface of the MgO film, so as to partially cover the (111) crystal face of the MgO film.

11. The plasma display panel according to claim 10, wherein the MgO single crystals are uniformly distributed in such a manner that a crystal face opposite to the (100) crystal face of the MgO single crystals is in contact with the surface of the MgO film.

12. The plasma display panel according to claim 2, wherein the mean value of the coverage factors is in a range from 0.1 to 10%.

13. A method for manufacturing the plasma display panel according to claim 2, wherein the MgO single crystals are adhered on the MgO film by spray-applying a slurry, where a density of the MgO single crystals is in a range from 0.01 to 2 wt %, onto the MgO film from the upper position under the condition that an atomizing pressure is 150 kPa or more and 300 kPa or less.

* * * * *